United States Patent [19]

Nakayama et al.

[11] Patent Number: 4,484,436

[45] Date of Patent: Nov. 27, 1984

[54] PROCESS FOR PRODUCING A TWISTED YARN

[75] Inventors: Takashi Nakayama; Seiichi Yamagata, both of Otsu; Koji Kajita, Shiga, all of Japan

[73] Assignee: Toray Industries, Inc., Tokyo, Japan

[21] Appl. No.: 508,496

[22] Filed: Jun. 27, 1983

Related U.S. Application Data

[62] Division of Ser. No. 249,354, Mar. 31, 1981, Pat. No. 4,414,800.

[30] Foreign Application Priority Data

Apr. 1, 1980 [JP] Japan ..... 55-42223
Oct. 31, 1980 [JP] Japan ..... 55-152332
Nov. 17, 1980 [JP] Japan ..... 55-160896

[51] Int. Cl.[3] ..... D02G 3/28

[52] U.S. Cl. ..... 57/328; 57/3; 57/13; 57/14

[58] Field of Search ..... 57/216, 236, 238, 252, 57/255, 256, 315, 328, 330, 331, 3, 13, 14

[56] References Cited

U.S. PATENT DOCUMENTS 507,232 10/1893 Maertens ..... 57/315
2,260,229 10/1941 Nutter et al. ..... 57/252 X
2,662,560 12/1953 Jackson ..... 57/236 X
2,775,858 1/1957 Kruse ..... 57/328 X
2,996,873 8/1961 Armstrong ..... 57/315
3,009,309 11/1961 Breen et al. ..... 57/315
3,020,697 2/1962 Henry ..... 57/315
3,079,746 3/1963 Field, Jr. ..... 57/328 X
3,099,907 8/1963 Masurel et al. ..... 57/328
3,365,872 1/1968 Field, Jr. ..... 57/328 X
3,367,095 2/1968 Field ..... 57/328 X
3,427,647 2/1969 Field, Jr. ..... 57/6 X
3,732,684 5/1973 Csok et al. ..... 57/207
3,802,174 4/1974 Landwehrkamp et al. ..... 57/5
3,831,369 8/1974 Northup et al. ..... 57/225
3,835,637 9/1974 Russell ..... 57/249
3,835,639 9/1974 Rhyne ..... 57/2
3,844,098 10/1974 Plate et al. ..... 57/236 X
4,003,194 1/1977 Yamagata et al. ..... 57/328
4,219,998 9/1980 Farnhill ..... 57/328 X

FOREIGN PATENT DOCUMENTS 8135 1/1977 Japan ..... 57/328
37932 10/1978 Japan ..... 57/328

*Primary Examiner*—Donald Watkins
*Attorney, Agent, or Firm*—Austin R. Miller

[57] ABSTRACT

A process for producing a twisted yarn is provided. A sheaf of staple fibers is drafted and bundled to form a bundled sheaf of staple fibers having substantially zero initial twist. At least two such bundled sheaves are then twisted together to form the twisted yarn.

14 Claims, 11 Drawing Figures

PROCESS FOR PRODUCING A TWISTED YARN

BACKGROUND OF THE INVENTION

This application is a division of copending application Ser. No. 249,354, filed Mar. 31, 1981, now U.S. Pat. No. 4,414,800.

This invention relates to a process for producing a twisted yarn by twisting a plurality of bundled, untwisted sheaves of staple fibers with a small number of finishing twists.

Conventionally, ordinary highly bundled spun yarns or worsted yarns having high bulkiness, a loose twist and softness have been produced by spinning a single yarn with a small number of twists by use of the ordinary ring spinning process, then doubling a plurality of single yarns thus formed and then applying a finishing twist to the resulting yarn in the direction opposite to the direction of twist of the single yarns, in order to detwist them and remove their initial twist.

However, since the conventional method requires numerous production steps such as rewinding, doubling and twisting after the single yarn is spun by use of a ring spinning frame having low spinning efficiency, such method requires a great deal of labor and energy, resulting in high production cost.

To reduce production cost, an attempt has been made to make use of a single loosely twisted yarn of high bulky yarn, but there is an inevitable restriction in the lower limit of the number of twists in conjunction with the ends down of the spun yarn. Another problem with this method is that the surface quality is poor when a knitted fabric is produced. Further, the attainable bulkiness is lower than that of two folded yarn. For this reason, this method has not been generally employed.

DESCRIPTION OF THE PRIOR ART

Recently, large numbers of novel twistless spinning methods have been reported which utilize false twist.

As a typical example of these prior art methods, mention can be made of U.S. Pat. No. 3,079,746. This patent discloses a so-called "fasciated spun yarn" consisting of a core bundle which is substantially devoid of real twist and surface fibers tightly twisted around the core sheaves of staple fibers in an irregular helical form having varying angles falling within the range of 10 to 80 degrees.

On the other hand, British Pat. No. 1,357,992 teaches the use of high-shrinkage staple in blend form with the above-mentioned fasciated spun yarn.

However, the major premise for the production of these heretofore known untwisted spun yarns by fasciation is that they have sufficient single yarn strength to be used as a single yarn. Accordingly, efforts are made to assure that the minor surface wrapper fibers are distributed as uniformly and evenly as possible, and that they are tightly fastened to the bundle of untwisted core fibers.

Accordingly, untwisted fasciated spun yarn having such construction has a rather coarse feeling in comparison with conventional ring spun yarn. Consequently, adjustment of feel is necessary. In the case of loosely twisted yarn of high-bulk yarn, the fasciated spun yarn is clearly inferior to the ring spun yarn and cannot be used as its substitute.

Another twistless spinning method has been known, which produces a twistless yarn, utilizing the binding power of a sizing agent which is removed from the product at the finishing stage. However, this method has not generally been employed because specific and laborious procedures are necessary for applying, drying and removing the sizing agent.

It has accordingly been difficult to reduce the cost of production in worsted spinning of loosely twisted yarn and high-bulk yarn for which softness and swelling characteristics are required, either by increasing spinning speed or by reducing the number of production steps applied.

SUMMARY OF THE INVENTION

The present invention is accordingly directed to a process for producing a twisted yarn which does not possess the drawbacks of the twistless spinning method, which makes it possible to produce a product having substantially equal quality to that of loosely twisted yarn, or high-bulk yarn produced in accordance with conventional ring spinning, and which can be produced with remarkable reduction in cost.

The process of the present invention is characterized by the steps of drafting sheaves of staple fibers, supplying them to a bundling zone to bundle them together, the initial twist of each of which is substantially zero, and thereafter continuously twisting the doubled sheaves of staple fibers, either after winding or without winding. This process produces a twisted yarn which consists principally of staple fibers, and is characterized in that a plurality of twistless sheaves of staple fibers are twisted with one another.

DESCRIPTION OF THE PREFERRED EMBODIMENTS

Figure 1:
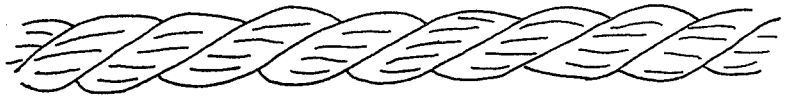
FIG. 1 shows a segment obtained by folding the conventional ring twisted yarns.

FIG. 1 shows a conventional ring-spun twisted yarn. Two single yarns, each provided with initial "Z" twist, are twisted together in the "S" direction, in such a manner and to such degree the initial twists are removed. Accordingly, the single yarns acquire bulking properties and softness. Structurally, the individual fibers are arranged substantially along the axis of the twisted yarn.

Figure 2:
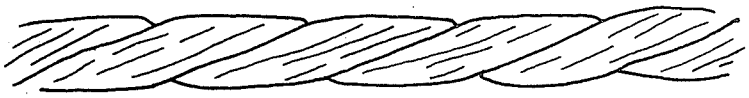
FIG. 2 shows a similar segment, utilizing twisted yarns in accordance with one embodiment of the present invention.

By contrast, FIG. 2 shows an example of a twisted yarn in accordance with the present invention. A plurality of bundles, untwisted sheaves of staple fibers having an initial twist of substantially zero are twisted together. In the embodiment in FIG. 2, two bundled sheaves of staple fibers are twisted.

The term "bundle" used in this specification means an agglomeration of fibers in which each single fiber has structurally a certain degree of cohesion but in which the fibers are hardly restricted. That is to say, the degree of adhesion between the fibers is extremely low in relation to its strength. Further, it includes partially fasciated portions formed by wrapping fibers or by partially interlacing portions, or by aggregating by false twisting or by rubbing. Accordingly, the single yarn forming the twisted yarn of the present invention is not of itself a perfect spun yarn. Therefore, it cannot be used by itself in subsequent processing steps as a single yarn.

It is important in accordance with the present invention that at least two single yarns, existing in such an imperfect state, are twisted with one another. When the finishing twist is applied, the staple fibers of one of the single yarns are restrained with respect to the staple fibers of the other single yarn, so that the staple fibers are restricted or bound to the twisted yarn, thereby forming a true yarn for the first time.

Since the restriction of the individual fibers is drastically lower in the twisted yarn of the present invention than in conventional ring-spun yarn or conventional fasciated spun yarn as described above, the twisted yarn of the present invention has the excellent characteristic that the properties inherent in the staple fibers are caused to be reflected in the properties of the yarn produced. Thus, softness and bulkiness in the final yarn are created in accordance with this invention.

Figure 3:
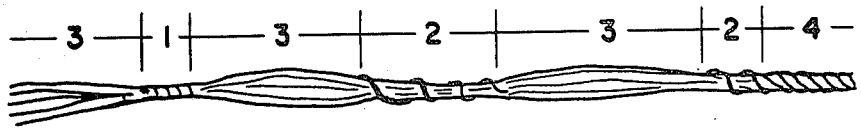
FIG. 3 shows a segment of a single yarn used for preparing a twisted yarn in accordance with the present invention, in which bundling is effected by partial fasciation.

FIG. 3 of the drawings shows a single yarn in which bundling is effected by partial fasciation in accordance with one aspect of the present invention. In this case, the wrapper fibers are distributed only locally so that tightly wrapped portions 1 do not frequently occur, and loosely wrapped portions 2, and portions 3 which are free from any wrapping, occupy major portions along the length of the yarn. The ratio of the portions in which the wrapper fibers are present along the longitudinal axis of the yarn is not greater than about 50% and is mostly below about 30%. In this connection it should be observed that the sheaves of staple fibers are substantially untwisted but they may include some amount of alternate twisting, or even real twisted portions 4, due to the alternate twisting applied.

Besides the above-mentioned partially fasciated portions due to the presence of wrapper fibers, the bundled sheaves of staple fibers in accordance with the present invention have a tendency to form interlaced portions due to fluid treatment, or to form slight alternate twists to such an extent that the fibers do not cohere with one another due to their own torque. However, the degree of interlacing or alternate twisting must be such that the sheaves of staple fibers are merely aggregated to a minimum degree. If these interlaced or alternately twisted portions are present to such a degree that they contribute considerable strength to the single yarn, the objects of the present invention cannot be attained.

The degree of bundling of the sheaves of staple fibers can be expressed in terms of the coefficient of finishing twist utilization (hereinafter referred to as "RF"), and this value must be at least 150%. It is defined as follows:

$$RF = \frac{\text{strength of twisted yarn}}{\text{strength of double yarn after detwisting of finish twist}} \times 100\ (\%)$$

If such strong fasciated, interlaced or alternately twisted portions are present that they provide an RF value below about 150%, it becomes essentially impossible to obtain the bulkiness, softness and uniformity applied to the twisted yarn in accordance with this invention.

To obtain remarkable qualities of softness and bulkiness, the sheaves of staple fibers are preferably bundled in such a manner as to obtain an RF value which is as high as possible. Generally, bundling is so effected as to obtain an RF value of at least about 200%, more preferably at least about 250%.

As referred to herein, the calculation formula of the RF value is based upon the condition that the yarn consists of 100% staple fibers. If the yarn contains filaments, the calculation is carried out by subtracting the strength value of these continuous filaments from each strength value utilized in the RF formula.

The number of the finish twists used in the practice of the present invention is the minimal number necessary to restrict the staple fibers forming each single yarn to such an extent that the production steps may be carried out smoothly. The greater the number of finish twists, the greater becomes the restriction applied to each single fiber and more serious becomes the loss of softness and bulkiness. When the number of the finish twists is too low, insufficiency of strength, inferior appearance and yarn breakage tend to occur. Thus, the number of finish twists is within the range of about 25 to 60 in terms of the finishing twist constant of the twisted yarn, and the preferable range from the viewpoint of strength and bulkiness is from about 35 to 45. In other words, in conventional ring spun yarn the number of initial twists per unit of length cannot be reduced much in conjunction with the breakage of the yarn and, hence, the number of the finish twists is also inevitably restricted. By contrast, the number of finish twists of the twisted yarn of the present invention may be half or below half the number of the finish twists used in conventional ring-spun yarn.

The twist constant of the finish twist is expressed by the following equation:

$$\text{constant of finishing twist } K = \frac{\text{number of finishing twists } (T/m)}{\sqrt{(\text{metric count of single yarn}) \div (\text{number of yarn ends})}}$$

Since the initial twist is zero, the direction of the finish twist may be either S or Z. If fasciated portions of wrapper fibers are present, however, it is suitable to achieve some of the objects of the present invention that the direction of the finish twist is opposite the helical direction of the wrapper fibers, that is to say, in such a direction that the fasciation of the wrapper fibers is weakened by the finish twist.

There is no restriction with respect to the nature of the fibers to be used in accordance with this invention, or to the fiber length, in particular. That is, any staple fibers which can be used in any production steps including the cotton spinning system and the worsted spinning system may be used. However, when softness and bulkiness are to be emphasized by the use of a lower number of finish twists, it is preferred to use fibers having a longer fiber length in conjunction with fiber strength. The kinds of fibers to be used are optional and synthetic fibers, chemical fibers, natural fibers or mixtures thereof may be used.

The twisted yarn in accordance with the present invention described above has a yarn structure such that the initial twist is substantially zero and the number of finish twists is small and for this reason, it has the following characteristics:

(1) When the twisted yarn of the invention is made of staple fibers having high bulking ability for producing a knitted fabric, stitches can be obtained which are more beautiful in appearance than those of conventional ring-twisted two-ply yarns. Particularly, the knitted fabric is free from loop-like swelling portions occurring in conventional ring spun yarn, and hence the stitches of the fabric have a neat appearance.

(2) When a cut pile is produced in a fabric made of twisted yarns of the present invention, the opening properties of the pile are superior as compared to fabrics made of conventional two-ply ring-twisted yarns.

(3) Since migration of individual fibers is less pronounced in single yarns and their parallelism is excellent, the resulting luster is high as compared to ordinary ring-spun yarns.

Next, consideration will be given to the situation in which the twisted yarns of the present invention contain stretchable filaments. The twisted yarns of the present invention may contain various types of continuous filaments. Especially when filaments are used which have stretchability, or are caused to exhibit stretchability by heat-treatment or the like, the tightening forces among the staple fibers is so low that this stretchability characteristic can be used effectively in the twisted yarn.

Figure 4:
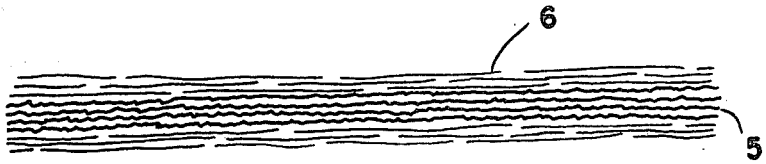
FIG. 4 shows a section of another embodiment of a single yarn in which a twisted yarn prepared according to the present invention contains woolly textured yarns.
Figure 5:
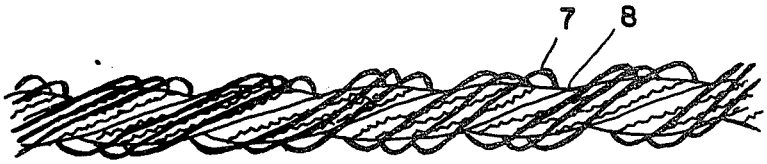
FIG. 5 shows the twisted yarn prepared according to the present invention which is formed by twisting two single yarns of the type shown in FIG. 4.

FIG. 4 is a sectional view showing an example of a single yarn containing crimped filaments. The staple fibers 6 are arranged to encompass the crimped filaments 5. They are not twisted but are bundled into a single bundle. Two single yarns of such configurations are twisted and are then subjected to heat treatment in a free condition, thereby allowing the filaments to develop their crimps and thereby to shrink. This condition is shown in FIG. 5. According to this arrangement, the loosely arranged staple fibers 7 in the single yarn bulk outside the yarn and the crimped filaments 8 are located at the core portion of the yarn. This produces a yarn which is extremely soft and yet has high stretchability.

Consequently, if a woven fabric is produced using a twisted yarn of the present invention containing filaments such as crimped filaments, the stretchability of which can be developed at a later stage, there can be obtained a woven fabric which has low stretchability until the weaving step is performed and which can be subsequently processed under ordinary conditions but can also be shrunk by heat-treatment or the like at the finishing step, and thereby provide stretchability.

Figure 6:
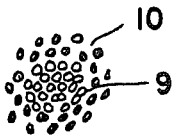
FIGS. 6(A) and 6(B) are sectional views of yarns prepared in accordance with this invention, showing the relative positions between crimped filaments and staple fibers in a twisted yarn of the present invention.
Figure 6:
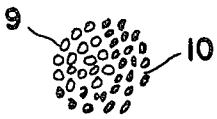

As to the relationship of the relative positions of the staple fibers and the crimped filaments in the yarn, it is most desirable that the staple fiber 10 fully encompass the crimped filaments 9 so as not to expose the crimped filaments on the yarn surface, as shown in FIG. 6(A). However, the crimped filaments 9 may be exposed to the surface while they are adjacent to one another, as shown in FIG. 6(B).

If stretchability is not desired, there is no limitation with respect to the relationship of the positions between the filaments and the staple fibers.

The twisted yarn may be produced by a variety of methods in accordance with the present invention.

The apparatus used comprises a combination of an ordinary roller drafting means with a bundling device, as will be further described.

Figure 7:
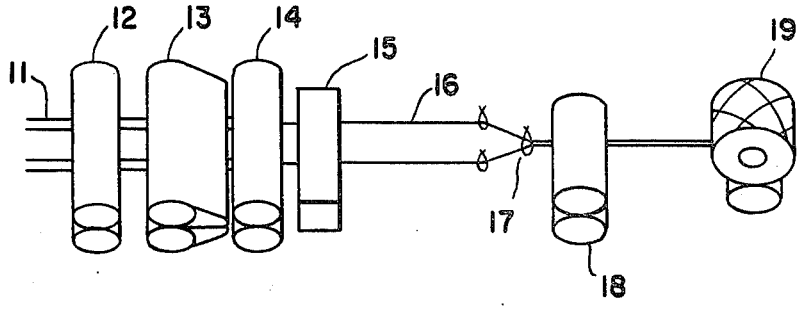
FIG. 7 shows an example of one form of production method in accordance with the present invention.

In FIG. 7, two sheaves 11 of fiber bundles (as shown) consisting of staple fibers are drafted by rollers 12, 13, 14 and are fed to a bundling device 15. This bundling device 15 may be of such a type that it provides the sheaves of staple fibers with a certain degree of aggregation as exemplified by aggregation attained by a false twisting device, an interlacer, or a rubbing machine or the like. The sheaves of staple fibers 16 thus bundled by the bundling device 15 are doubled by conducting them through a guide 17. They then pass through a delivery roller 18 while being doubled and are then taken up onto a cheese 19. The doubled sheaves of staple fibers taken up onto the cheese are directly furnished with a finishing twist by a twisting machine not shown, and are thus formed into a twisted yarn.

In this case, it is also possible to apply the finishing twist directly to the doubled yarn by disposing a ring twisting machine downstream of the delivery roller without taking up the twisted yarn once on the cheese as shown in FIG. 7, and by then taking up the twisted yarn.

Figure 8:
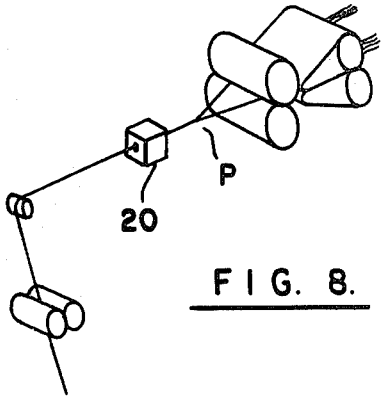
FIG. 8 shows another form of production method in accordance with the present invention.

FIG. 8 shows another embodiment of the present invention in which a bundling device utilizing false twist is employed. Instead of using one device for one yarn as shown in FIG. 7, this embodiment passes two yarns through one false twist device to obtain two bundled, untwisted double yarns. In other words, when the two yarns are twisted by the false twist device 20, the twist of the doubled yarn extends back to a certain point P, and above this point P the twist is applied to each yarn. Accordingly, each single yarn is twisted and the doubled yarn is detwisted after it passes through the false twist machine. Thus, it is possible to obtain the same action and effect as that of two false twist machines for two single yarns.

Figure 9:
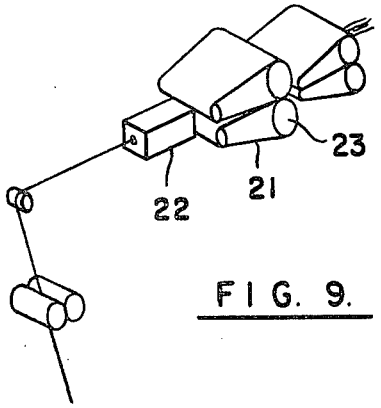
FIG. 9 shows still another form of production method in accordance with the present invention.

FIG. 9 shows still another embodiment of this invention using a false twist bundling device. A conveyor band 21 is provided as a means for controlling the false twisted sheaf of staple fibers and free fibers that are not completely involved in the false twist, and for delivering them. The use of such a conveyor band 21 makes it possible to increase the number of fasciated fibers around the untwisted sheaf of staple fibers thus bundled, thereby also increasing the pull resistance of the sheaf. This leads to better workability when the sheaf of staple fibers is taken up onto a cheese and twisted. An effect similar to that provided by a conveyor band would be obtained if conveyor means such as an air duct or an aspirating jet were disposed between the false twist device 22 and the front roller 23.

In spinning by means of false twist, it is not suitable in the practice of the present invention to allow the amount of fasciated fibers to become so great that they can be used sufficiently to provide a single yarn. When a conveyor band 21 or the like is employed, therefore, conditions must be so established that the number of fasciated fibers is relatively small and that they are wrapped loosely.

In order to reduce the number of wrapped fibers, it is effective to reduce the overfeed ratio (hereinafter referred to as "OFR") in the false twist zone. The OFR value is below about 3%, preferably from about 0 to 1%. This value is given by the following equation:

$$OFR = \frac{VF - VD}{VF} \times 100(\%)$$

where VF is the front roll speed and VD is the delivery roll speed.

It is also effective to reduce the width of the sheaf of staple fibers to be fed to the front roller by disposing a width-restricting collector for the sheaf of staple fibers between the second roller and the front roller. It is preferred that the width be below 70 $\sqrt{1/N}$ (mm), where N is a metric count of the single yarn. When no collector is used, it is preferred to make use of a roving having twist.

It is also possible to reduce the number of wrapping fibers by reducing the number of twists applied to the yarn by the false twisting device.

Thus, it is important in the practice of the present invention that the aforementioned RF value should be at least about 150. This is achieved by suitably setting the conditions such as OFR, the fiber width, the twisting force and the like, so as to control the number of wrapper fibers.

The false twist device may be of a spindle type or of any of a variety of available mechanical types, but from the aspect of easy threading and high twist capacity, false twisting by means of an air jet is suitable.

Figure 10:
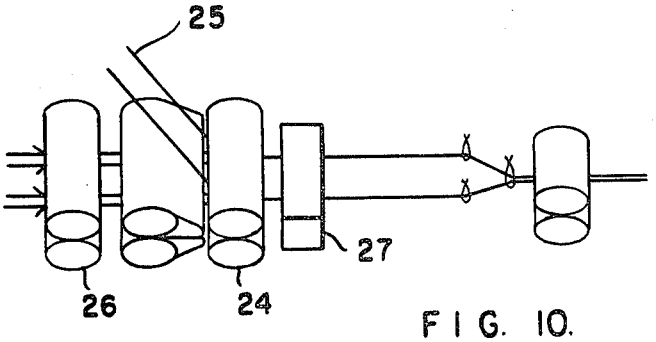
FIG. 10 shows a still further form of production method in accordance with the present invention, in which the continuous filaments are supplied.

FIG. 10 shows still another embodiment of this invention which shows a method of producing twisted yarn containing continuous filaments. In this figure, continuous filaments 25 fed from a roller 24 are integrated with staple fibers drafted by the rollers 26, 24 and are then fed to a bundling device 27. When the feed of the filaments is effected in such a manner that they are located at the center of the staple fibers drafted at the nip point of the roller 24, the portions at which the staple fibers wrap the filaments become greater in number. In this case, it is effective to feed the sheaf of staple fibers in a greater width. More definitely, a feed in the form of sliver or two rovings is preferable.

In any event, at least two kinds of free fibers are generally caused to appear during false twisting. One comprises free fibers both ends of which are detached from the fiber bundle, and the other comprises free fibers only one end of which is detached from the bundle. Both kinds of free fibers are free from twisting action and they have not received substantial twist in the process.

In the production method of the present invention described above, since the single yarn strength of the spun yarn is extremely low, breakage is likely to occur. To minimize breakage, it is preferred to shorten the distance between the bundling device and the delivery roller or the front roller. The greater the fiber length of the fiber used, the smaller the frequency of occurrence of breakage. Doubling of the two yarns may be effected either upstream or downstream of the delivery roller, but occurrence of yarn breakage is minimized when the single yarns are taken up to the delivery roller in front of the bundling device or immediately after they are doubled, rather than when they are taken as single yarns.

Since the spun yarns are merely bundled and the restriction of the single fibers is low, unevenness in the end surface is likely to occur when the yarns are wound into a cheese. Hence, the surface pressure of the winder is preferably low.

When the yarns are wound into a cheese and are then twisted in a separate step, specific consideration must be taken whether the yarns consist of 100% staple, because the double yarn has a strength corresponding only to the pull resistance of the bundled yarns. In other words, it is preferred to use staple fiber having considerable fiber length, preferably at least about 150 mm, for a part of the whole of the fibers, in order to provide the yarn with a strength to withstand the twisting step by means of fiber length and pull resistance.

If a ring twisting machine is used, therefore, it is necessary to shorten as much as possible the distance from the creel to the feed roller and to utilize mechanical means in conjunction with the creel so as to reduce tension during unwinding of the yarn from the cheese. Since the distance between the unwinding point of the cheese to the twisting point is small, a double twister is suitable for the process of the present invention.

When the yarns are continously twisted and taken up without being wound onto a cheese, spinning is feasible even if the fiber length is small. In this case, doubling is effected upstream of the delivery roller and twisting is effected immediately downstream of the delivery roller. A pneumatic suction port is disposed downstream of the delivery roller so that the spun yarn is once sucked into the pneumatic port and is then threaded, using a guide yarn in the same way as in ordinary ring spinning.

When a false twist device is used as the bundling device, the resulting yarn becomes a yarn in which fasciated portions are partially present and when an interlacing device is used as the bundling device, the resulting yarn becomes a yarn in which interlaced portions are partially present, but they are so adjusted that the RF value reaches at least about 150%. In other words, if the fasciated fibers or the interlaced portions of the yarn increase, the yarn becomes longitudinally non-uniform so that fabrics produced from the yarn become non-uniform and, at the same time, the softness and bulkiness of the yarn become insufficient for the purpose. If fasciated fibers are not present at all, the pull resistance of the double yarn is reduced so that such a yarn is not suitable when twisting is effected as a separate step.

In accordance with the method of this invention as described above, spinning of the loosely twisted yarn becomes possible and high-speed spinning also becomes possible if air false twisting or air interlacing is employed for the bundling device. In the case of cheese winding, high-speed spinning of at least 150 m/min. becomes possible.

Since the number of finishing twists may as well be small, it becomes possible to increase the twisting speed and to improve the productivity markedly in comparison with conventional spinning methods. The production process can also be simplified, for example, to spinning and twisting or to spinning only. Thus, the method of the present invention greatly contributes to reduction in cost of production of high-bulk yarn and loosely twisted yarn.

The following are specific examples of the present invention. They are not intended to limit the scope of the invention, which is defined in the appended claims.

EXAMPLE 1

Acrylic tow, 3 denier per filament, was draftcut by "Turbostapler" (trademark, produced by Turbo Machine Co., U.S.A) into high-shrinkage sliver having a shrinkage of 27% in boiling water. Next, part of this sliver was heat-treated at 100° C. for 15 minutes by a steam setter and was thus converted into low-shrinkage sliver. 40% high-shrinkage sliver and 60% low-shrinkage sliver were mixed by a gill and were converted into a roving of a thickness of 1 g/m by a bobbinor.

From this roving was spun a 1/32 Nm yarn by a spinning frame comprising the combination of a 3-line apron drafting part, the transfer means by the conveyor band shown in FIG. 9 and an air false twister. The two single yarns pulled out from the delivery roller were doubled and were then taken up as a double yarn onto a cheese. The spinning conditions were as follows:

| | |
|---|---|
| delivery roller speed | 150 m/min. |
| OFR | 0.67% |
| width-restricting collector | 12 mm |
| air pressure to false twisting nozzle | 3.0 kg/cm$^2$ |
| twist direction of false twist nozzle | S |

Next, the yarn thus taken up was provided with a finishing twist of 160 T/m (twist constant K=40) in the S direction to form a twisted yarn.

Unlike the conventional fasciated spun yarn, this twisted yarn had a soft feel. When this twisted yarn was subjected to steam-treatment in the free state, a bulky yarn was obtained.

Table 1 illustrates comparatively the yarn properties of this twisted yarn and those of a ring two ply yarn produced from the same sliver. As can be seen, the twisted yarn of the present invention exhibits the same bulkiness as the ring-spun yarn.

TABLE 1

| | yarn count (Nm) | strength of twisted yarn (g) | strength of double yarn after de-twisting of finishing twist (g) | RF (%) | bulkiness (cm$^3$/g) |
|---|---|---|---|---|---|
| | | yarn of this invention | | | |
| before heat-treatment | 2/32 | 1056 | 302 | 350 | — |

TABLE 1-continued

| | yarn count (Nm) | strength of twisted yarn (g) | strength of double yarn after de-twisting of finishing twist (g) | RF (%) | bulkiness (cm$^3$/g) |
|---|---|---|---|---|---|
| after heat-treatment | 2/24.2 | 845 | 158 | 535 | 22.0 |
| | | ring yarn | | | |
| before heat-treatment | 2/36 | 765 | 714 | 107 | — |
| after heat-treatment | 2/27.4 | 613 | 544 | 113 | 23.1 |

Yarn strength was measured using a Tensilon machine. When knitted fabrics were produced and compared with each other using the resulting bulky yarn, respectively, the knitted fabric using the twisted yarn of the present invention was devoid of random deformation of stitching lines in the wale direction that occurred in knitted fabric produced from the ring spun yarn, and had high quality.

When these yarns were compared as pile yarns in knit goods, the twisted yarn of the invention possesed much better opening properties than did the ring-spun yarn.

EXAMPLE 2

Acrylic tow composed of 2-denier filaments was draft cut, partially heat-treated and made into sliver in the same way as in Example 1, to produce a roving having a thickness of 1.2 g/m. The roving was spun into yarns of two levels using the same spinning frame as used in Example 1. Thereafter a finishing twist of 160 T/m in the S direction was applied to each yarn. The yarn of Level-1 was the twisted yarn of the present invention and the spinning conditions for this yarn were OFR 0.5%, spinning speed 150 m/min., fiber width-restricting collector 4 mm-width and air pressure 2.5 kg/cm$^2$. The yarn of Level-2 was conventional fasciated spun yarn and the spinning conditions for this yarn were OFR 5%, collector width 12 mm, spinning speed 100 m/min. and air pressure 3.0 kg/cm$^2$. The strength and feel of these two yarns were compared. The results are illustrated in Table 2 below.

TABLE 2

| | | count | strength of twisted yarn (g) | strength of double yarn after de-twisting of finishing twist | RF (%) | bulkiness (cm$^3$/g) | Feel |
|---|---|---|---|---|---|---|---|
| level-1 | before heat-treatment | 2/31.6 | 1075 | 38.9 | 2763 | — | extremely soft |
| | after heat-treatment | 2/24.4 | 731 | 79 | 925 | 25.9 | |
| level-2 | before heat-treatment | 2/31.8 | 979 | 812 | 121 | — | coarse feeling and hard |
| | after heat-treatment | 2/23.0 | 726 | 613 | 118 | 17.5 | |

EXAMPLE 3

Mixed sliver was produced using 40% high-shrinkage sliver of acrylic staple 0.7 d×128 mm (variable), and 60% low-shrinkage sliver, 7 d×128 mm (variable), and yarns of 1/10 Nm were spun at an OFR of −2% without a collector using apparatus having the same construction used in Example 1, and were then doubled and taken up. Thereafter, a twist of 134 T/m (twist constant of 60) in the S direction was applied by a ring twisting machine. The properties of the resulting twisted yarn after heat-treatment were compared with those of a ring-spun yarn produced from the same material. The results are shown in Table 3. Though a bulkiness equal to that of the ring-spun yarn could not be obtained, the twisted yarn had superior softness that could not be obtained from the conventional fasciated spun yarn.

TABLE 3

| | count | strength of twisted yarn (g) | strength of double yarn after detwisting of finishing twist (g) | RF (%) | bulkiness ($cm^3/g$) |
|---|---|---|---|---|---|
| yarn of this invention | 2/7 | 2040 | 1308 | 157 | 28.2 |
| ring spun yarn | 2/7 | 2180 | 1817 | 120 | 42.9 |

EXAMPLE 4

Acrylic tow composed of 3-denier single yarns and acrylic tow of 5 denier were draft-cut using a Turbo stapler to obtain high-shrinkage slivers having average fiber lengths of 180 mm. Next, the 3-denier sliver was heat-treated at 100° C. for 15 minutes in a steam setter to obtain low-shrinkage sliver. 60% of this 3-denier sliver and 40% of the high-shrinkage 5-denier sliver were mix-spun using a gill to obtain a sliver having a weight of 1 g/m.

Using the apparatus shown in FIG. 8, using one air false twister for two yarns, the resulting sliver was spun 2/32 Nm and the yarn was continuously provided with a finishing twist of 160 T/m in the S direction by use of a ring twisting machine, without winding the cheese. The twisted yarn thus formed had a considerable amount of surface fuzz but exhibited high bulkiness and softness. It had a strength of 939 g before heat-treatment and a bulkiness of 26.4 $cm^3/g$ after heat-treatment.

EXAMPLE 5

Acrylic tow composed of 5-denier single yarns was draft-cut in a Turbo stapler to obtain sliver having a heat shrinkage ratio of 27%. 40% of this sliver and 60% of a sliver of acrylic staple of 3 denier×102 mm (variable) were spun to obtain sliver having a weight of one gram/meter.

The resulting sliver was spun in 2/32 Nm by an apparatus using air false twist as shown in FIG. 7, and was then doubled and taken up onto a cheese. Next, finishing twist was applied to the cheese using a double twister. The relationship between the finishing twist and strength is shown in Table 4. The bulkiness of the yarn became better with a decreasing number of the finishing twists. The strength was found to fall with a practically usable range up to a twist constant of K=25. However, yarn splitting became substantial and appearance became inferior with a decrease in the number of twists.

TABLE 4

| No. of twists (T/m) | twist constant K | strength (g) | strength CV (%) | stretchability (%) |
|---|---|---|---|---|
| 241 | 60 | 1080 | 8.5 | 14.0 |
| 207 | 50 | 1020 | 9.2 | 13.7 |
| 181 | 45 | 1106 | 7.1 | 13.9 |

TABLE 4-continued

| No. of twists (T/m) | twist constant K | strength (g) | strength CV (%) | stretchability (%) |
|---|---|---|---|---|
| 161 | 40 | 1080 | 7.4 | 13.9 |
| 139 | 35 | 1072 | 9.7 | 14.2 |
| 121 | 30 | 968 | 9.3 | 13.3 |
| 99 | 25 | 1000 | 8.6 | 14.1 |
| 81 | 20 | 996 | 11.7 | 18.3 |

EXAMPLE 6

The staple fiber was a mixed fiber spun from 20% of anit-pilling polyester of 3 d×89 mm (variable) and 80% of wool #64. The crimped filaments were wooly polyester finished yarn of 75 d-24 f. Using an apparatus shown in FIG. 10, a yarn of 1/48 was spun and two yarns were doubled and were then wound onto a cheese. The bundling machine was an air false twister.

The resulting double yarn had a construction in which the staple fibers encompassed the wooly finished yarn. Though the double yarn had some fasciated portion, the staple fibers were hardly restricted and were capable of readily moving.

A finishing twist of 200 T/m was applied to the double yarn using a ring twister. The resulting twisted yarn had the property of passing through various production steps in the same way as ordinary spun yarns. No problem of occurrence of neps was found even after the yarn was exposed to abrasive action.

When this yarn was steam-set in the free state, it was found to have high stretchability, with a stretch ratio of 29.7%; yet the yarn was highly bulky.

We claim:

1. A process for producing a twisted yarn comprising the steps of:

drafting a sheaf of staple fibers;

bundling said sheaf to form a bundled sheaf of staple fibers having substantially zero initial twist;

twisting at least two of said bundled sheaves upon each other, and maintaining the strength of the bundled sheaf in a manner to provide a coefficient of finishing twist utilization of more than 150%.

2. The process according to claim 1, wherein said sheaves are doubled prior to the twisting step.

3. The process according to claim 2, wherein twisting is continuously carried out after doubling without winding said yarn.

4. The process according to claim 2, wherein twisting is carried out after winding which is carried out after doubling.

5. The process according to any of claims 1,2, 3 and 4, wherein said bundling step comprises false twisting.

6. The process according to claim 1, wherein free fibers are applied to the surface of said sheaf by false twisting means and thereby converted to binding fibers wrapped around said bundled, untwisted sheaves of staple fibers.

7. The process according to claim 6, wherein at least one end of said free staple fibers is detached from the surface of said sheaf and does not receive substantial twist in said false twisting zone, and wherein said free staple fibers are wrapped around said sheaf while said sheaf is detwisted after leaving said false twisting step.

8. The process according to claim 5, wherein a bundling of each of said plurality of sheaves is simultaneously carried out using a single false twister.

9. The process according to claim 5, wherein the overfeed ratio (OFR) expressed by the following equation I in false twisting zone is less than 3%:

$$OFR\ (\%)\ \frac{V_F - V_D}{V_D} \times 100 \qquad [I]$$

wherein VF represents the supply speed (m/min.) of said sheaf to said false twisting zone and VD represents the delivery speed (m/min.) of said sheaf from said false twisting zone.

10. A process for producing a twisted yarn comprising the steps of:

drafting a sheaf of staple fibers;

bundling said sheaf to form a bundled sheaf of staple fibers having a core having an initial twist of substantially zero and having wrapping around said core; and twisting at least two of said bundled sheaves upon each other with a coefficient of finishing twist utilization greater than 150%, said coefficient of finishing twist utilization (RF) being defined by the formula:

$$RF = \frac{STy}{SUTy} \times 100$$

where STy is the strength of the twisted yarn and SUTy is the strength of the yarn after detwisting the finishing twist.

11. The process according to claim 10, wherein said twisting step is carried out at a finishing twist constant of from 25 to 60, wherein said finishing twist constant K is defined by the formula:

$$K = \frac{\text{number of finishing twists } (T/m)}{\sqrt{\dfrac{\text{metric count of single yarn}}{\text{number of spun ends}}}}.$$

12. The process according to claim 10, wherein said bundling step comprises wrapping staple fibers around said core and maintaining said sheaf staple fibers substantially parallel to the axis of said sheaf.

13. The process according to claim 10, wherein said wrapping fibers are distributed only locally during bundling.

14. The process according to claim 10, wherein said wrapping fibers are wrapped along the longitudinal axis of said core to wrap less than about 50% of said core.

* * * * *